US006301852B1

(12) United States Patent
Eshelman

(10) Patent No.: US 6,301,852 B1
(45) Date of Patent: Oct. 16, 2001

(54) WINDOW GLAZING ASSEMBLY

(75) Inventor: H. Jay Eshelman, Putney, VT (US)

(73) Assignee: The Woodstone Company, Westminister, VT (US)

( * ) Notice: Subject to any disclaimer, the term of this patent is extended or adjusted under 35 U.S.C. 154(b) by 0 days.

(21) Appl. No.: 09/316,183

(22) Filed: May 21, 1999

(51) Int. Cl.[7] ..... E06B 3/70
(52) U.S. Cl. ..... 52/456; 52/395
(58) Field of Search ..... 52/456, 311, 400, 52/395

(56) References Cited

U.S. PATENT DOCUMENTS

| | | | | |
|---|---|---|---|---|
| Re. 30,432 | | 11/1980 | Stoakes . | |
| 3,221,462 | | 12/1965 | Pomeroy . | |
| 3,678,651 | * | 7/1972 | Hicks | 52/311 |
| 4,070,806 | | 1/1978 | Hubbard . | |
| 4,250,673 | | 2/1981 | Hubbard . | |
| 4,437,284 | | 3/1984 | Cribben et al. . | |
| 4,598,520 | | 7/1986 | Ellstrom . | |
| 4,730,429 | * | 3/1988 | Roberts | 52/309.13 |
| 4,845,911 | * | 7/1989 | Winston et al. | 52/456 |
| 4,949,521 | | 8/1990 | Riegelman et al. . | |
| 5,040,347 | * | 8/1991 | Valvis | 52/397 |
| 5,048,252 | | 9/1991 | Osborn . | |
| 5,088,255 | | 2/1992 | Emanuel . | |
| 5,222,339 | | 6/1993 | Hendrickson et al. . | |
| 5,465,539 | | 11/1995 | Rose . | |
| 5,737,890 | | 4/1998 | Heyden . | |
| 5,791,102 | * | 8/1998 | Sheath et al. | 52/204.7 |

* cited by examiner

*Primary Examiner*—Alvin Chin-Shue
*Assistant Examiner*—Curtis A. Cohen
(74) *Attorney, Agent, or Firm*—Shlesinger, Arkwright & Garvey LLP

(57) ABSTRACT

A window or door glazing assembly for providing structural support to the window or door frame, the assembly includes a muntin comprising a reinforcing bar fixedly secured to opposite sides of a window frame and having a pair of muntin faces removably secured to the sides of the reinforcing bar whereby the muntin face may be disassembled from the reinforcing bar to permit access to the window panes for purposes of replacement or maintenance.

26 Claims, 5 Drawing Sheets

WINDOW GLAZING ASSEMBLY

FIELD OF THE INVENTION

The present invention relates to window and door structures and in particular, to a muntin assembly for securing and sealing multiple glass panes within a window or door.

BACKGROUND OF THE INVENTION

In recent years, energy efficient custom built windows and doors have been made available to consumers. Energy efficient windows and doors are typically constructed of wood, which is a better insulator than metal or plastic. In addition, the glass panes are glazed whereby first and second glass panes are supported in a spaced parallel array within the window and include a peripheral spacer frame positioned between the glass panes thereby creating a pocket of air which functions as an insulator. Triple and quadruple-glazed windows include third and fourth glass panes respectively are also known and provide even better insulative properties.

As is apparent, the sash, door and glazed panels are subject to failure due to wind load, impact from wind blown objects, seal failure, vandalism or accident. Recent revisions to building code requirements have increased the structural and impact resistance performance standards for windows and doors beyond that provided by traditional wooden sash and door components and fabrication methods. On the other hand, permit requirements for new and renovation construction projects often include strict historic landmark provisions, as well as other design parameters, that require manufacturers to maintain specific material use and fabrication methods that typically cannot conform to the more recent structural and impact resistance performance standards.

In the past and currently, window and door manufacturers have incorporated an "applied grille" fabrication process that relies primarily on the structural properties of various glass composites used in full-light glass panels to attain required performance standards. In this process, wooden grilles are applied to the exposed face of the full light glass panel to simulate the appearance of individual glass panes within the window or door frame. Repair and maintenance of the glass panels included in this fabrication method necessitates replacement of the complete sash or grille elements, a process both time consuming and expensive.

Accordingly, a need has existed in the art for a window glazing system in which structural and aesthetic conformance does not restrict the inevitable and efficient maintenance of multiple individual glass panes within the window or door frame whereby individual panes of glass can be removed and/or replaced without the need for replacing or removing the sash, in its entirety, from the window or door jamb.

OBJECTS AND SUMMARY OF THE PRESENT INVENTION

It is therefore an object of the present invention to provide a window and door glazing system that permits periodic replacement of the glass panels without having to replace the complete sash or grill elements which remain fixed to the sash or window or door.

A still further object of the present invention is to provide a window glazing system that will allow periodic replacement of the inner insulating glass panels and the sash elements including stiles, rails and glazing stops.

Yet another object of the present invention is to provide muntin bars that function to not only create true divided light through the window glass but also to provide added structural support to the window or door.

It is yet a further object of the present invention to provide a window glazing system that is convenient and easy to assemble during the manufacturing and installation of the window and door while at the same time provides unblemished appearance of the interconnecting muntin members, even following replacement of the glass panes.

A still further object is to provide a glazing assembly that will provide increased structural and impact resistance performance for windows and doors beyond that provided by traditional wooden sash and door components and fabrication methods, comply with historic landmark provisions and other design parameters which require manufacturers to maintain specific material use and fabrication methods and conform with current structural and impact resistance performance standards for windows and doors.

In summary, the present invention is directed to a window or door glazing assembly comprising at least one muntin extending between the frame of a door or window for supporting at least one glass pane therein, the at least one muntin including a continuous reinforcement bar having opposite first and second ends, a top surface and bottom surfaces and respective side surface, the reinforcement bar is secured to separate sides of the window or door frame, the at least one muntin further including at least one removable muntin cover secured to a side of the reinforcement bar and in a substantially perpendicular relation thereto to provide window glazing for the at least one glass pane whereby the at least one glass pane is adapted to be removed without removal of said reinforcement bar from the window or door frame.

The present invention is further directed to a muntin as set forth above as well as a door or window having a muntin assembly as set forth above.

These and other objects will become apparent from the following description of the invention taken together with the drawings and claims.

DETAILED DESCRIPTION OF THE PREFERRED EMBODIMENTS

Figure 1:
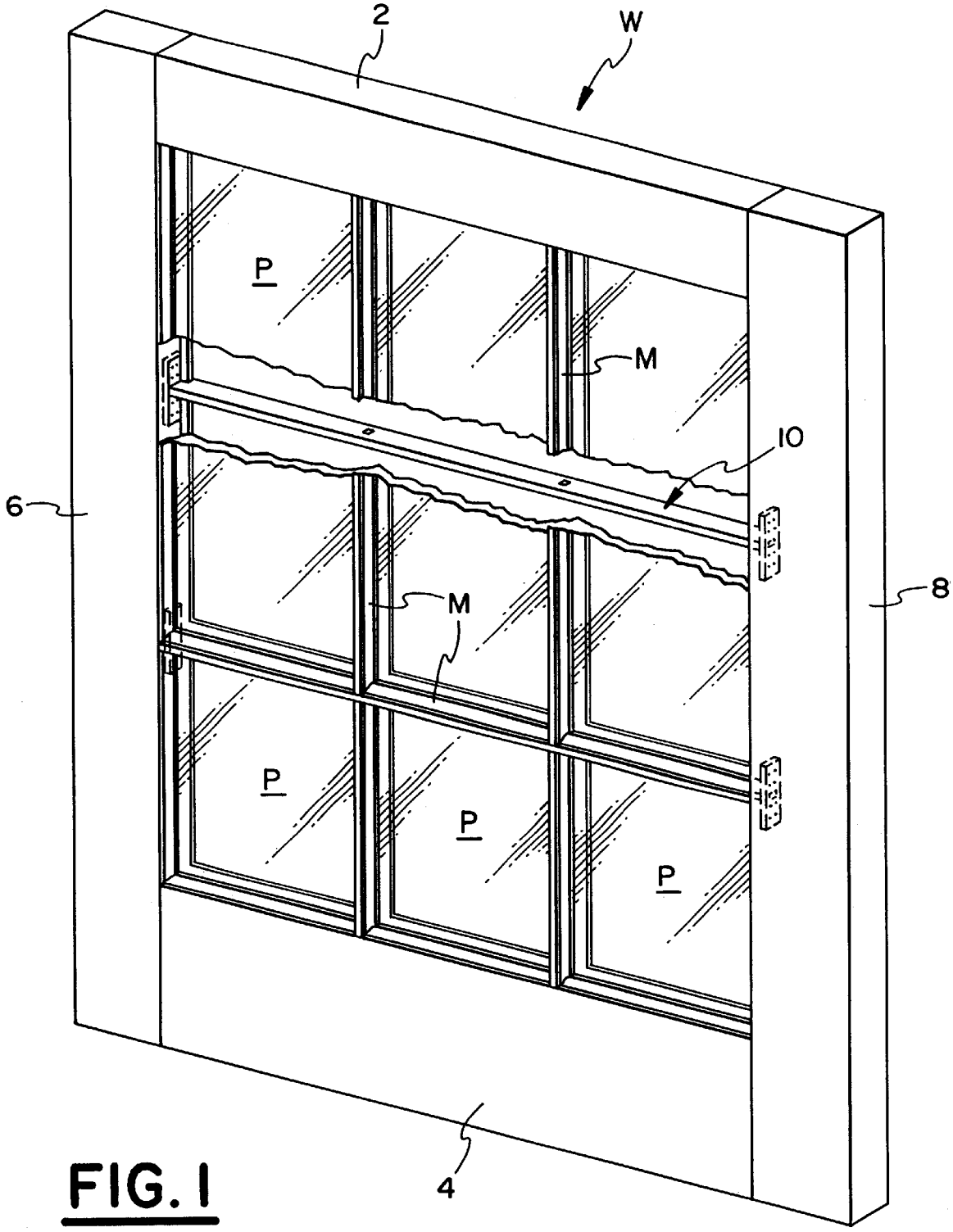
FIG. 1 is a perspective view of the glazing assembly according to the present invention installed within a window and showing portions of the glass panes and muntins broken away to expose the muntin reinforcement bar and showing the bar plates in phantom lines.
Figure 2:
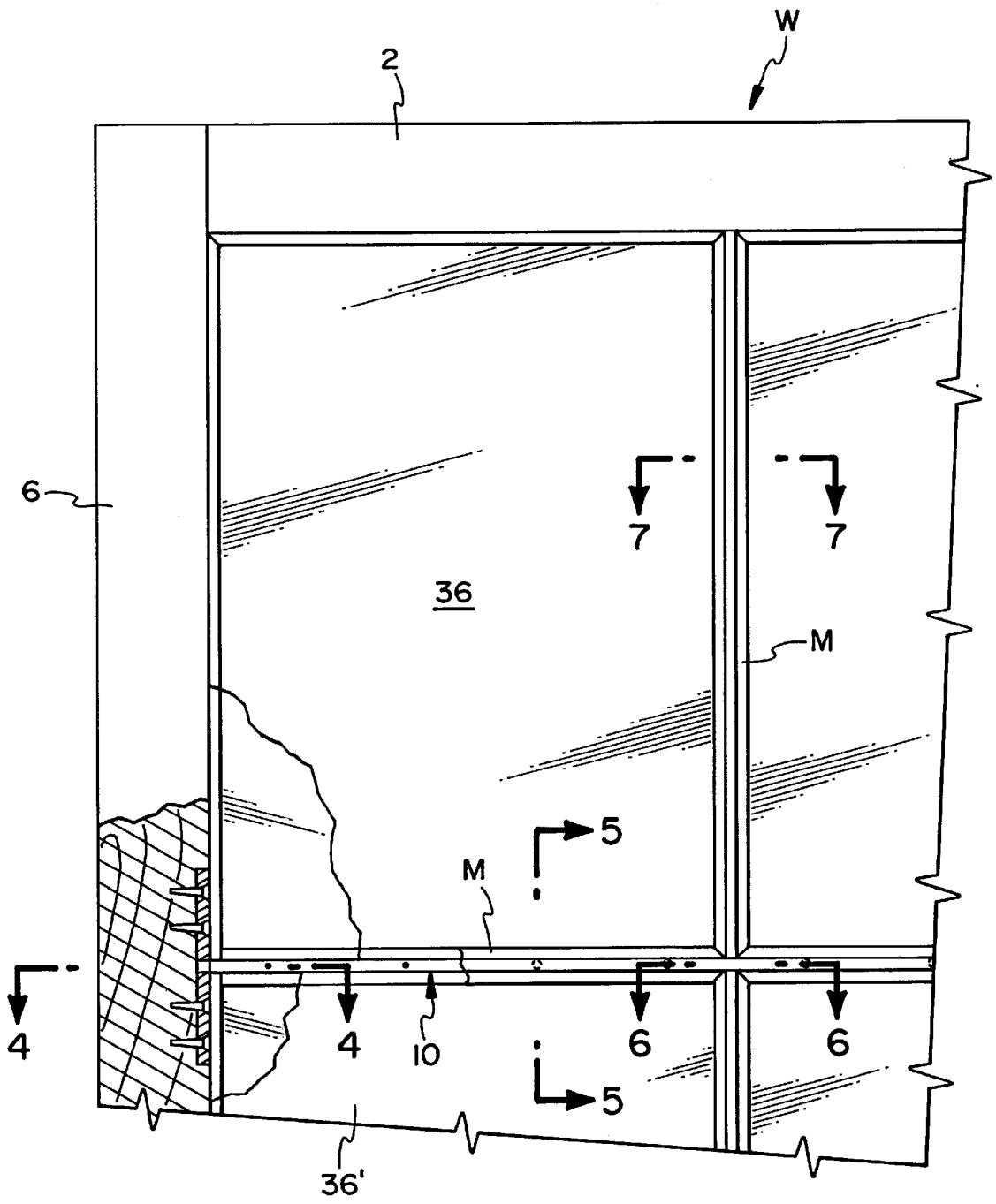
FIG. 2 is an enlarged, partial view of the window shown in FIG. 1 with portions of the window sash shown in section to illustrate interconnection of the bar plate and reinforcement bar assembly.

Turning to FIGS. 1 and 2, the glazing assembly according to the present invention is shown in use with a window W.

The present invention is applicable to a variety of window and door constructions including, but not limited to, fixed and double-hung sashes, outswing and inswing casements windows and doors, awnings, hoppers, tilt and turn, sliding windows and doors, mortise lock and passage sets, multi-point locking systems and the like. In addition, the dimensions of the individual frame components are variable and it is within the scope of the present invention to provide any of the traditional and contemporary window and door constructions now in use.

As best shown in FIG. 1, window W includes a peripheral frame member comprising a top rail 2, bottom rail 4 and stiles 6 and 8 interconnected in the known manner. Also provided are intersecting vertical and horizontal muntins M that extend across the window frame for providing glazing to glass panes P and in a manner as will be described below. The length, width and shape of the various frame members and muntins is variable depending upon design considerations. In addition, a variety of wood materials and synthetic materials may be used in construction of the window and the glazing assembly of the present invention.

Figure 3:
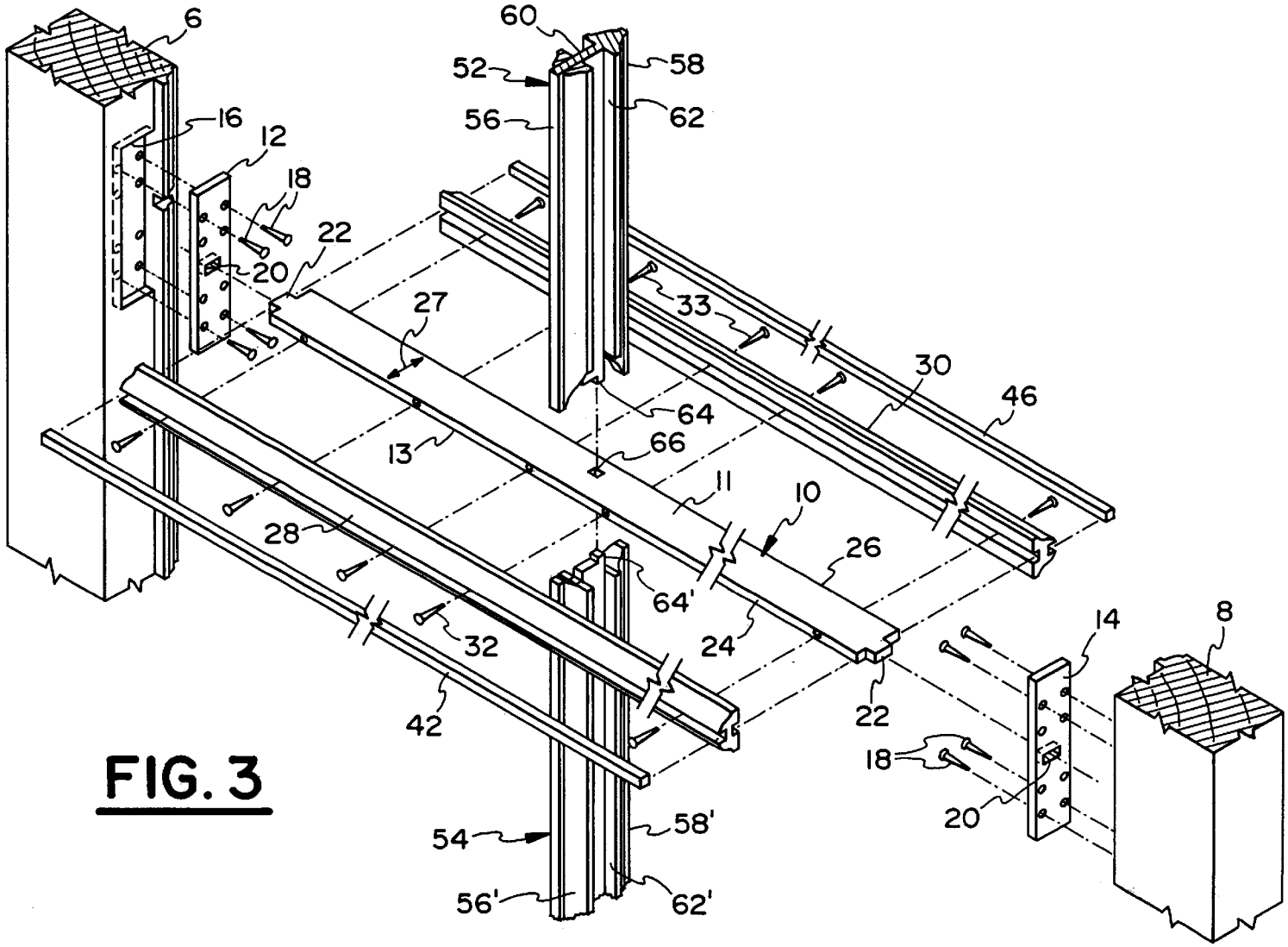
FIG. 3 is a partial exploded view of the glazing assembly of the present invention with the window frame and the segmented muntins broken away.

Turning to FIG. 3, elements of the glazing assembly are shown in greater detail and comprise at least one fixed reinforcing bar 10 horizontally extending between and secured at each end to stile members 6 and 8 respectively. The reinforcing bar 10 has an elongated shape and a generally planar construction with a top surface 11 and bottom surface 13 and opposite side faces 24 and 26. The bar 10 will have a width, as indicated by arrow 27, that corresponds to the desired distance between a cooperating pair of glass panes to be secured by the glazing assembly. As is apparent, the bar may be constructed from metal or other rigid material and have varying thicknesses, shapes and the like depending upon design requirements. A single muntin reinforcing bar 10 is shown for purposes of illustrating the basic features of the invention; however, additional bars may be provided, each being operatively associated with a separate muntin. It is of course within the scope of the present invention to provide a vertically extending reinforcing bar corresponding to a vertically extending muntin, the bar extending from a top rail to a bottom rail of the window or door. Other reinforcing bar and muntin positions as well as construction materials are within the scope of the present invention.

Reinforcing bar 10 is secured at opposite ends to the stiles 6 and 10 with bar plates 12 and 14. Each of the bar plates 12 and 14 are shown to be countersunk within a recess 16 extending into the stiles 6 and 10 of the window frame. The bar plates are attached to the stiles with nails or screws 18 or other securing devices. Each bar plate includes an opening or passageway 20 configured to interfit with a tenon 22 extending from each end of reinforcing bar 10. This provides a mortise and tenon interlock between the reinforcing bar 10 and the bar plates 12 and 14 to rigidly secure the reinforcing bar 10 to the stiles 6 and 8 of the window frame. As is apparent, it is within the scope of the present invention to provide various other methods for attaching or interlocking the reinforcing bar to the stiles (or to the top and bottom rails) of the window provided such method firmly secures the reinforcing bar to the window (or door) frame members.

A faux muntin or muntin face 28 is removably secured to the side 24 of reinforcing bar 10 and extends the length of reinforcing bar 10. A second muntin face 30 is also provided and similarly secured to an opposite side 26 of reinforcing bar 10. The muntin faces 28 and 30 are termed faux or false since they provide the aesthetic appearance of a traditional muntin while at the same time are selectively removable from the window without requiring full disassembly of the underlying reinforcing bar 10 which not only provides support for the muntin faces but also provides structural support for the window (or door) frame.

Figure 5:
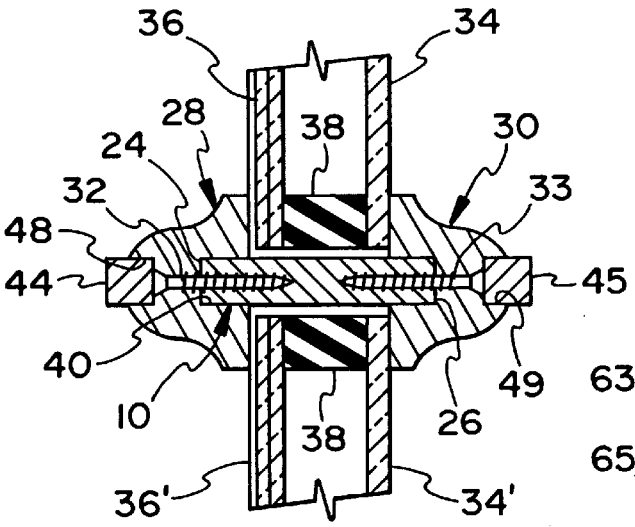
FIG. 5 is an enlarged sectional view taken along lines 5—5 of FIG. 2 showing the muntin faces secured to the reinforcing bar.

The interconnection of muntin faces 28 and 30 to reinforcing bar 10 for glazing a pair of window panes is best shown in FIG. 5. An inboard glass pane 34 and an outboard laminated glass pane 36 are secured between muntin faces 28 and 30 to provide an insulating airspace between the panes. As is apparent, glass panes 34' and 36' are likewise secured. A seal 38 is provided and extends between the glass panes 34 and 36. An elongated slot 40 extends into and along the length of muntin face 28 and is configured to interfit and receive a side 24 of reinforcing bar 10. The muntin face 28 is secured to the reinforcing bar 10 with exterior bar screws 32 countersunk into a recess 48 in muntin face 28. A muntin cap 44 is interfit with the recess 48 of muntin face 28 in the manner shown to cover the bar screws 32. A corresponding arrangement is provided for the opposite muntin face 30 including a bar screw 33, recess 49, and muntin cap 45.

Figure 4:
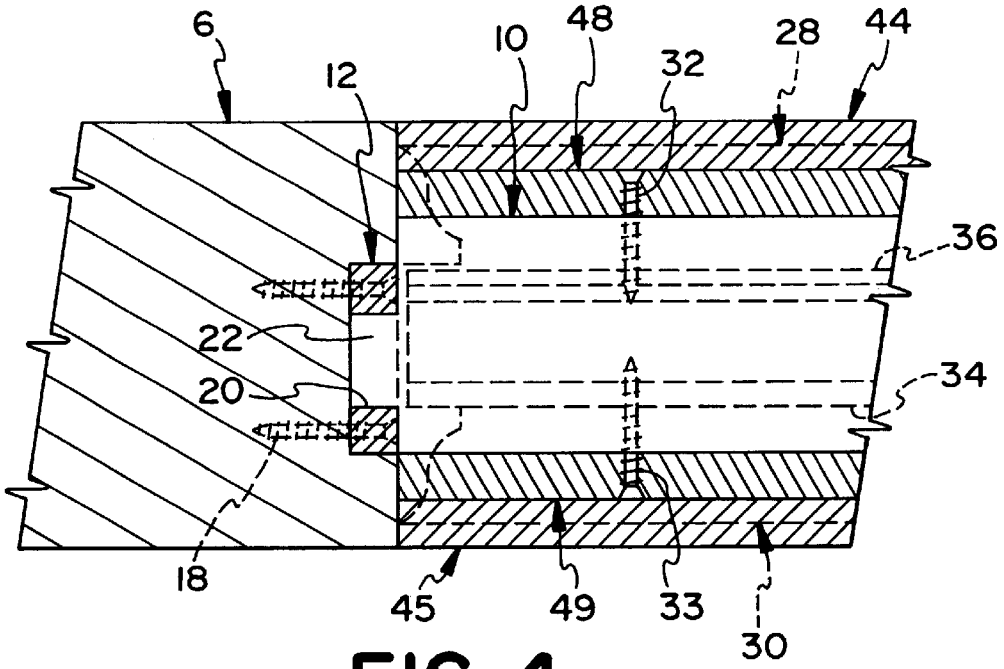
FIG. 4 is an enlarged sectional view taken along lines 4—4 of FIG. 2 and showing interconnection of the reinforcing bar to the bar plate.

FIG. 4 best illustrates details of the glazing assembly according to the present invention when assembled to a stile 6 of window W and in particular, the interfit of the reinforcing bar 10 to the bar plate 12 wherein the tenon 22 of the reinforcing bar 10 is shown to extends within passageway 20 of bar plate 12.

Returning to FIG. 3, additional muntins can be seen that do not extend the length of the reinforcing bar 10. These segmented muntins 52 and 54 are shown to extend along the vertical axis of the window and intersect the reinforcing bar 10 including associated muntin faces 28 and 30 at right angles to also provide glazing for the glass panes. As is apparent, these segmented muntins may be arranged in a variety of other configurations and locations within the window frame depending upon the desired design of the window. Each of the segmented muntins 52 and 54 are shown to generally provide an interior muntin 56 and exterior muntin 58 having respective channels 60 and 62 therebetween for receiving and glazing glass panes.

Figure 7:
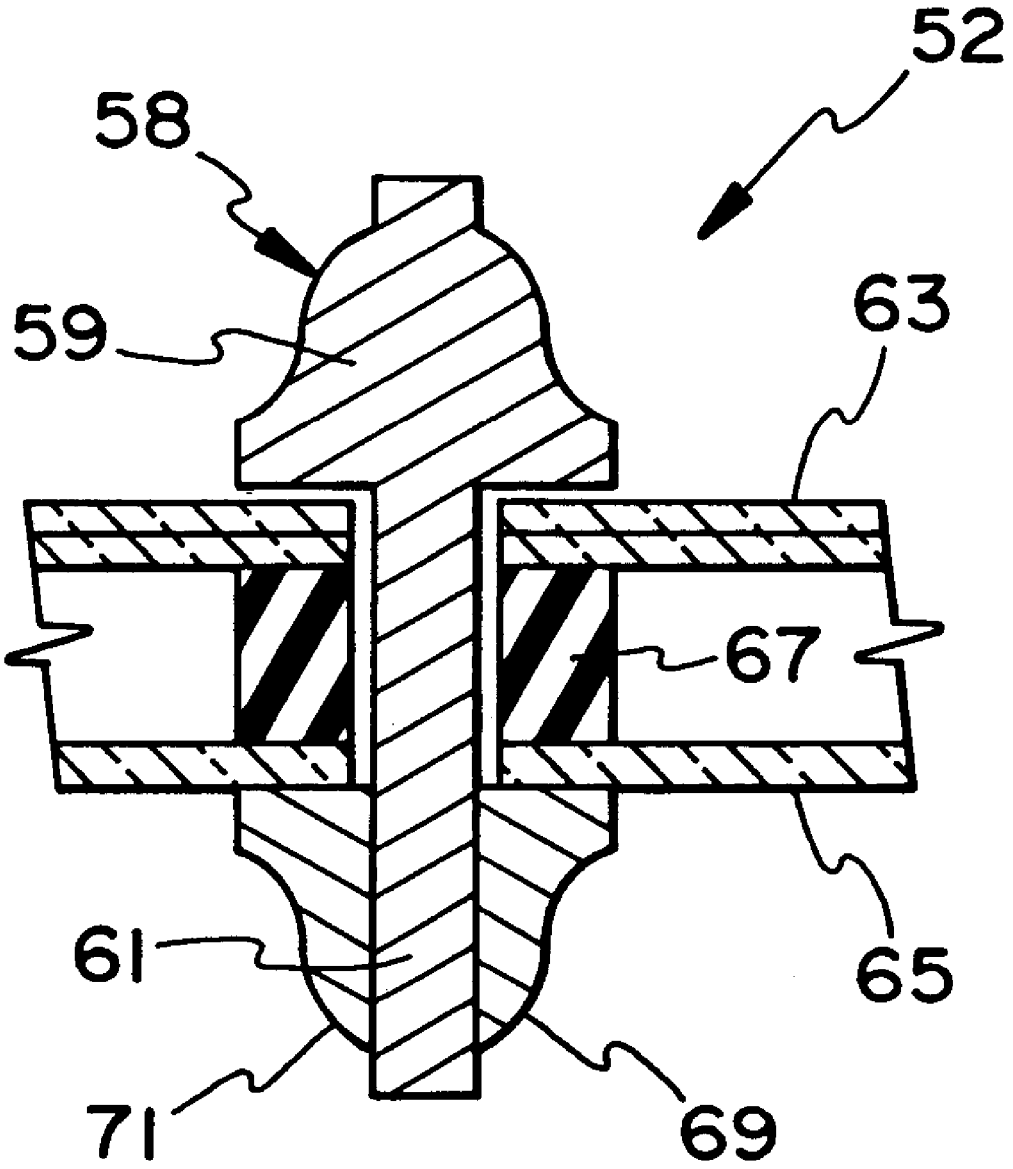
FIG. 7 is an enlarged sectional view taken along lines 7—7 of FIG. 2.

FIG. 7 shows a preferred construction for one such segmented muntin 52 wherein the exterior muntin 58 includes a shaped element 59 with a post or bar 61 extending perpendicular from element 59 a selected distance, and in the example shown, a distance sufficient to accommodate exterior laminated glass panes 63 and interior glass pane 65 separated by seal 67. A pair a glazing stops 69 and 71 are provided and attached to the post or bar 61 using nails or other securing device to provide glazing for the interior glass pane 65. Sealant is also applied in the known manner. As can be appreciated, if a single glass pane is to be glazed, the depth of the post or bar 61 will be shortened accordingly. In the usual case, the lengths of shaped element 59, post or bar 61 and glazing stops 69 and 71 are approximately the same.

Figure 6:
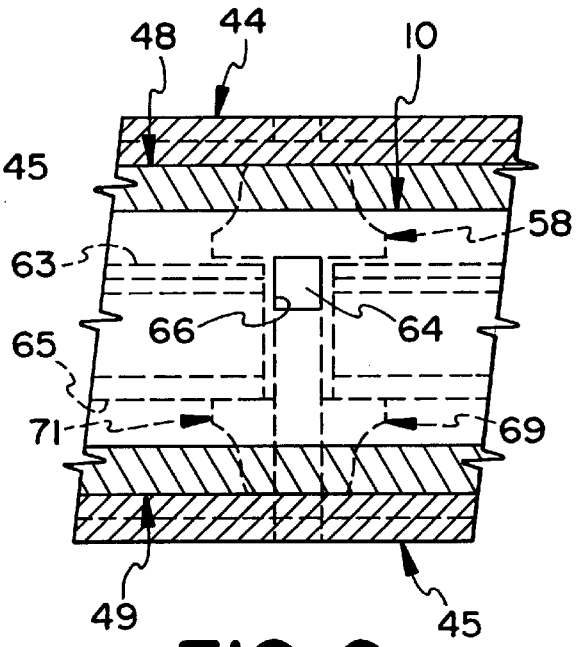
FIG. 6 is an enlarged sectional view taken along lines 6—6 of FIG. 2.

Returning to FIG. 3, the end of segmented muntin 52 is provided with a tenon 64 configured to interfit a passageway 66 extending through the top and bottom surfaces of the reinforcing bar 10. This is best shown in FIG. 6. As is apparent, other approaches to attaching the segmented muntin to the reinforcing bar are within the scope of the present invention so long as the locking system may be readily disassembled. For example, a pin or dowel may be used to interlock the segmented muntin to the reinforcing bar 10. Segmented muntin 54 is likewise provided with an interior muntin 56', exterior muntin 58' and channels 60' and 62' and has a similar construction to that shown in FIG. 7. As is apparent, the ends of the segmented muntins are cut to permit a clean interfit against the muntin faces 28 and 30 to provide an aesthetically pleasing appearance. Further, it is within the scope of the present invention to secure the segmented muntins to the top and bottom rails (not shown) of the window in any manner, including, but not limited to, a mortise and tenon interlock, pins, dowels or other arrangement.

In use, the glazing assembly of the present invention will permit replacement and retrofitting of individual panes of glass, seals or the like without the need to remove or replace the sash or door in it's entirety from the window jamb or door jamb. More particularly, a user will simply disassemble the false muntins from the reinforcing bar at a given location by unscrewing the assembly. The underlying reinforcement bar remains in place. If necessary, the segmented muntin glazing stops are removed thereby exposing the glass pane or panes which may then be replaced or otherwise serviced.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A glazing assembly for supporting glass panes within a window or door frame, said glazing assembly comprising:

a) a support bar, said support bar provided with opposite first and second ends, a top surface, a bottom surface and respective side surfaces, each of said top and bottom surfaces adapted to support at least one glass pane, said support bar having a sufficient length for extending from a first side of a window or door frame to an opposite side thereof;

b) at least one segmented muntin, said at least one segmented muntin provided with opposite first and second ends for extending within the window or door frame and for supporting the at least one glass pane, said at least one segmented muntin extends perpendicular to said support bar and is interconnect therewith at one of said support bar top surface or said support bar bottom surface;

c) support bar anchoring plates, said support bar anchoring plates operatively associated with said support bar first and second ends for fixing said support bar to the first and opposite sides of a window or door frame in a manner to provide supplemental structural support for the same;

d) each of said support bar first and second ends provided with a tenon adapted to securely receive an opening extending into one of said support bar anchoring plates; and e) at least one support bar cover, said at least one support bar cover adapted to be releasibly secured to one of said support bar respective side surfaces to provide access to and for supporting the at least one glass pane whereby supplemental structural support of the window or door frame by said support bar is maintained following disassembly of said at least one support bar cover for removal or replacement of the at least one glass pane.

2. A glazing assembly as in claim 1 and wherein:

a) each of said support bar anchoring plates disposed perpendicular to said support bar.

3. A glazing assembly as in claim 2 and wherein:

a) each of said support bar anchoring plates and said support bar constructed from a material for providing the first and opposite sides of a window or door frame with supplemental structural support when said support bar is fixed thereto.

4. A glazing assembly as in claim 3 and wherein:

a) said material is a metal.

5. A glazing assembly as in claim 2 and wherein:

a) each of said support bar anchoring plates adapted to be countersunk into the first and opposite sides of a window or door frame.

6. A glazing assembly as in claim 2, and wherein:

a) said at least one support bar cover including a muntin face portion and a longitudinal slot adapted to receive one of said respective support bar side surfaces so that said muntin face is fixed perpendicular to said support bar.

7. A glazing assembly as in claim 1 and wherein:

a) said at least one segmented muntin comprising an exterior muntin portion and an interior muntin portion, said exterior muntin portion including a post member adapted to extend through said interior muntin portion and form a channel therebetween for receiving the at least one glass pane to support the same.

8. A glazing assembly as in claim 7 and further comprising:

a) a seal member, said seal member adapted to be positioned within said channel.

9. A glazing assembly as in claim 7 and wherein:

a) said interior muntin portion comprising a pair of glazing stops.

10. A glazing assembly as in claim 1 and wherein:

a) said at least one support bar cover extends the length of said support bar from said support bar first end to said support bar second end.

11. A glazing assembly as in claim 1 and wherein:

a) at least one of said at least one segmented muntin opposite first and second ends is configured to interfit against said muntin face portion of said at least one support bar cover.

12. A glazing assembly as in claim 1 and further comprising:

a) a further support bar including cooperating support bar anchor plates.

13. A window structure comprising:

a) a frame member providing an interior perimeter region;

b) at least one glass pane for support within said frame member;

c) a support bar, said support bar provided with opposite first and second ends, a top surface, a bottom surface and respective side surfaces, each of said top and bottom surfaces adapted to support said at least one glass pane, said support bar having a length sufficient to extend from a portion of said frame member interior perimeter region to an opposite portion thereof;

d) at least one segmented muntin, said at least one segmented muntin provided with opposite first and second ends and adapted to extend within said frame member interior perimeter region and support said at least one glass pane, said at least one segmented muntin extends perpendicular to said support bar and is interconnected therewith at one of said support bar top surface or said support bar bottom surface;

e) support bar anchoring plates, said support bar anchoring plates operatively associated with said support bar first and second ends for fixing said support bar to a first portion of said frame member interior perimeter region to an opposite portion thereof and in a manner to provide supplemental structural support for the same;

f) each of said support bar first and second ends provided with a tenon adapted to securely receive an opening extending into one of said support bar anchoring plates; and g) at least one support bar cover, said at least one support bar cover adapted to be releasibly secured to one of said support bar respective side surfaces to provide access to and for said at least one glass pane whereby supplemental structural support of said frame member interior perimeter region by said support bar is maintained following disassembly of said at least one support bar cover for removal or replacement of said at least one glass pane.

14. A window structure as in claim 13 and wherein:

a) each of said support bar anchoring plates disposed perpendicular to said support bar.

15. A window structure as in claim 14 and wherein:

a) each of said support bar anchoring plates and said support bar constructed from a material for providing said frame member interior perimeter region with supplemental structural support when said support bar is fixed thereto.

16. A window structure as in claim 15 and wherein:

a) said material is a metal.

17. A window structure as in claim 14 and wherein:

a) each of said support bar anchoring plates adapted to be countersunk into said frame member interior perimeter region.

18. A window structure as in claim 14 and wherein:

a) said at least one support bar cover including a muntin face portion and a longitudinal slot adapted to receive one of said respective support bar side surfaces so that said muntin face is fixed perpendicular to said support bar.

19. A window structure as in claim 13 and wherein:

a) said at least one segmented muntin comprising an exterior muntin portion and an interior muntin portion, said exterior muntin portion including a post member adapted to extend through said interior muntin portion and form a channel therebetween for receiving said at least one glass pane to support the same.

20. A glazing assembly as in claim 19 and further comprising:

a) a seal member, said seal member adapted to be positioned within said channel.

21. A glazing assembly as in claim 19 and wherein:

a) said interior muntin portion comprising a pair of glazing stops.

22. A window structure as in claim 13 and wherein:

a) said support bar is constructed from a material having greater structural and impact resistance than said frame member.

23. A glazing assembly as in claim 13 and wherein:

a) said at least one support bar cover extends the length of said support bar from said support bar first end to said support bar second end.

24. A glazing assembly as in claim 13 and wherein:

a) at least one of said at least one segmented muntin opposite first and second ends is configured to interfit against said muntin face portion of said at least one support bar cover.

25. A glazing assembly as in claim 13 and further comprising:

a) a further support bar including cooperating support bar anchor plates.

26. A glazing assembly for supporting glass panes within a window or door frame, said glazing assembly comprising:

a) a support bar, said support bar provided with opposite first and second ends, a top surface, a bottom surface and respective side surfaces, each of said top and bottom surfaces adapted to support at least one glass pane, said support bar having a sufficient length for extending from a first side of a window or door frame to an opposite side thereof;

b) at least one segmented muntin, said at least one segmented muntin provided with opposite first and second ends for extending within the window or door frame and for supporting the at least one glass pane, said at least one segmented muntin extends perpendicular to said support bar and is interconnect therewith at one of said support bar top surface or said support bar bottom surface;

c) support bar anchoring plates, said support bar anchoring plates operatively associated with said support bar first and second ends for fixing said support bar to the first and opposite sides of a window or door frame in a manner to provide supplemental structural support for the same;

d) each of said support bar first and second ends provided with a tenon adapted to securely receive an opening extending into one of said support bar anchoring plates; and e) a first support bar cover, said first support bar cover adapted to be releasibly secured to one of said support bar respective side surfaces to provide access to and for supporting the at least one glass pane and a second support bar cover, said second support bar cover adapted to be releasibly secured to the other of said support bar respective side surfaces for supporting the at least one glass whereby supplemental structural support of the window or door frame by said support bar is maintained following disassembly of said at least one support bar cover for removal or replacement of the at least one glass pane.

* * * * *